United States Patent [19]

Aoki

[11] 4,145,999

[45] Mar. 27, 1979

[54] ELECTRONIC FEEDBACK CONTROL SYSTEM FOR FUEL INJECTION IN INTERNAL COMBUSTION ENGINES OF FUEL INJECTION TYPE

[75] Inventor: Keiji Aoki, Susono, Japan

[73] Assignee: Toyota Jidosha Kogyo Kabushiki Kaisha, Toyota, Japan

[21] Appl. No.: 704,507

[22] Filed: Jul. 12, 1976

[30] Foreign Application Priority Data

Mar. 22, 1976 [JP] Japan ..... 51-30997

[51] Int. Cl.[2] ..... F02B 3/00

[52] U.S. Cl. ..... 123/32 EE

[58] Field of Search ..... 123/32 EE; 60/276, 285; 235/250.21

[56] References Cited

U.S. PATENT DOCUMENTS

| | | | |
|---|---|---|---|
| 3,782,347 | 1/1974 | Schmidt et al. | 60/276 |
| 3,815,561 | 6/1974 | Seitz | 123/119 R |
| 4,029,061 | 6/1977 | Asano | 123/32 EE |

OTHER PUBLICATIONS

Closed-Loop Electronic Fuel Injection Control of the Internal-Combustion Engine by J. G. Rivard, Published by Society of Automotive Engineers, paper presented at International Automotive Engineering Congress, Detroit, Mich., Jan. 8-12, 1973, pp. 1-16.

*Primary Examiner*—Charles T. Jordan

*Attorney, Agent, or Firm*—Stevens, Davis, Miller & Mosher

[57] ABSTRACT

An electronic system for fuel injection in internal combustion engines of the fuel injection type including a system which modifies the pulse length of the fuel injection control pulses by integration an on-off signal delivered from an air/fuel ratio sensor wherein the integration time constant is varied in accordance with the frequency of the on-off signal from the air/fuel ratio sensor so that the rate of increasing the injection quantity of fuel is increased in accordance with an increase in the engine intake air flow.

5 Claims, 4 Drawing Figures

ELECTRONIC FEEDBACK CONTROL SYSTEM FOR FUEL INJECTION IN INTERNAL COMBUSTION ENGINES OF FUEL INJECTION TYPE

BACKGROUND OF THE INVENTION

1. Field of the Invention

The present invention relates to an electronic control system for controlling fuel injection in internal combustion engines of the fuel injection type and, more particularly, an electronic control system of the feedback type employing a means for sensing the air/fuel ratio.

2. Description of the Prior Art

Electronic control systems for controlling fuel injection in internal combustion engines of the fuel injection type generally include means for computing the timing of the fuel injection so as to match the requirements of the engine in accordance with various input signals such as a trigger signal delivered from the distributor indicating the rotational speed of the engine, a signal taken from an intake vacuum sensor or an intake air flow sensor which represents engine load and other signals taken from various sensors switches and indicating other operational conditions of the engine and means for producing a pulse signal having a pulse length corresponding to the computed time of fuel injection, this pulse signal being supplied to a power amplifier which produces power output pulses for actuating fuel injection nozzles.

Such an electronic control system is generally an open loop system in accordance with the classification in the art of control systems. In recent years, however, in accordance with the requirements for exhaust gas purification, fuel economy and drivability of automobiles, efforts have been made to provide an electronic control system of the closed or feedback type by incorporating an air/fuel ratio sensor which detects the air/fuel ratio of the intake fuel-air mixture from the quantity of combustible components and residual oxygen contained in the exhaust gases of the engine. In such systems an on-off signal delivered from the sensor is supplied as an input to an integration circuit and the output from the integration circuit modifies the pulse length of the aforementioned pulse signal. The air/fuel ratio sensor generally produces two kinds of discretely different output values in opposite regions of the stoichiometric air/fuel ratio so that it provides on or off signal on the rich side and off or on signal on the lean side. Therefore, the output of the air/fuel ratio sensor is generally supplied to an integration circuit before it is fed into a control circuit. When an electronic feedback control system of this type is employed, if the air/fuel ratio of the fuel-air mixture supplied to the engine has shifted to the lean or rich side of a predetermined air/fuel ratio in accordance with a variation of the operational condition of the engine, the change is detected by the air/fuel ratio sensor which then produces an on-off signal. The on-off signal effects modification of the pulse length of the pulse signal, whereby the quantity of fuel required for correcting the air/fuel ratio to the predetermined value is increased or decreased at a predetermined rate, thus recovering the predetermined air/fuel ratio. The rate at which the fuel is increased or decreased is determined by the integration constant of the integration circuit to which the on-off signal from the air/fuel ratio sensor is supplied. In this connection, since there is a delay in the response of the exhaust gases in the variation of air/fuel ratio when compared with that in the intake fuel-air mixture, the delay corresponding to the sum of the delay time of gases in the combustion chamber and the time required for exhaust gases to travel through the exhaust system from an exhaust port to the air/fuel ratio sensor, it is noted that the rate at which the fuel is increased or decreased should preferably be increased or decreased in accordance with the increase or decrease of intake air flow as shown in FIG. 1. However, since in the conventional system the integration time constant in the integration circuit is fixed at a constant value, the control of the controlling air/fuel ratio when the engine is in a transient operation is different from that in a steady running condition thereby causing some inconsistency in adjusting the control system for optimum operation, resulting in a relatively rough control in actual operation.

SUMMARY OF THE INVENTION

The present invention obviates the aforementioned drawback in the conventional electronic feedback control system for fuel injection and provides an improved system wherein the integration constant of the integration circuit is varied in accordance with the variation of intake air flow so as to increase the rate at which the fuel is increased in accordance with an increase in the intake air flow thereby effecting optimum and high accuracy air/fuel ratio control over the entire operational region of the engine.

When feedback control is effected, the frequency of the on-off signal delivered from the air/fuel ratio sensor is determined by the delay in the exhaust system and, generally, there is a relation such as $f=\frac{1}{4}T$, wherein f is the frequency of the on-off signal and T is the delay time of the exhaust system. On the other hand, since the delay time T is inversely proportional to the intake air flow as diagrammatically shown in FIG. 2, the frequency f becomes proportional to the intake air flow; that is, the frequency becomes higher as the intake air flow increases.

Therefore, it is the primary object of the present invention to provide an electronic feedback control system for fuel injection having a circuit constitution which varies the integration time constant of the integration circuit in accordance with variation of the intake air flow. More particularly, the object of the present invention is to vary the integration constant of the integration circuit by utilizing the proportionally varying performance in the frequency of the on-off signal delivered from the air/fuel ratio sensor in accordance with variation of the intake air flow.

According to the present invention, the above-mentioned object is accomplished by an electronic feedback control system for fuel injection in internal combustion engines of the fuel injection type comprising an air/fuel ratio sensor which senses the air/fuel ratio of the intake fuel-air mixture from combustible components and residual oxygen contained in the exhaust gases and produces an on-off signal; an integration circuit which is supplied with an on-off signal and produces an integrated signal for controlling the fuel injection means, wherein the integration circuit includes an operational amplifier, a capacitor and a transistor having collector, emitter and base electrodes, the resistance between the collector and emitter forming a resistance for the integration circuit; and a frequency voltage converter for converting the on-off signal to an analog voltage signal which is supplied to the base of the transistor.

In a control system of the abovementioned constitution, an increase in the intake air flow causes a corresponding increase in the frequency of the on-off signal produced by the air/fuel ratio sensor. This frequency increase causes a corresponding increase in the output of the frequency-voltage converter thereby raising the base potential of the transistor with the result that the resistance between the collector and the emitter of the transistor is reduced thereby reducing the integration time constant of the integration circuit, thus finally increasing the rate of increasing or decreasing of the quantity of fuel. Consequently, the rate of increasing or decreasing of the quantity of fuel is automatically increased in accordance with an increase in the intake air flow, whereby an optimum adjustment for the air/fuel ratio control system is consistent in both the steady running condition and the transitional condition thereby establishing an optimum and high accuracy air/fuel ratio control over the entire operational region of the engine.

BRIEF DESCRIPTION OF THE DRAWING

In the accompanying drawing.

DESCRIPTION OF THE PREFERRED EMBODIMENT

Figure 3:
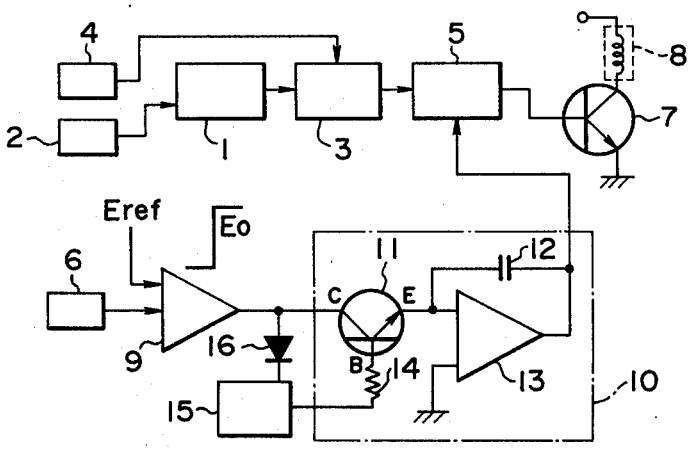
FIG. 3 is a block diagram showing an embodiment of the electronic feedback control system of the invention; and, FIG. 4 is a graph showing the output performance of the air/fuel ratio sensor with respect to the air/fuel ratio.

Turning now to FIG. 3, 1 is an engine rotational speed computing circuit which computes rotational speed of the engine depending upon a trigger signal supplied from a distributor 2 included in the ignition system of the engine and supplies a signal indicating the rotational speed of the engine to a basic pulse generating circuit 3. The basic pulse generating circuit 3 is also supplied with other control signals such as a signal from an intake air flow sensor 4 which itself is well known in the art and is provided in an intake passage (not shown) to detect intake air flow, a signal delivered from a water temperature sensor (not shown), etc., and the time or duration of fuel injection is computed to match the requirement of the engine depending upon the signals supplied thereto. In accordance with this computation, the basic pulse generating circuit produces a pulse signal including a series of pulses each being initiated with the engine rotational speed computing circuit 1 to provide a control signal to the circuit 3, each pulse having a pulse length corresponding to the computed time or duration for fuel injection. The pulse signal produced by the basic pulse generating circuit 3 is supplied to a basic pulse length modifying circuit 5 in which the length of individual pulses is modified to become longer or shorter depending upon the control signal delivered from an air/fuel ratio sensor 6 as explained in detail hereinunder. The pulse signal is then supplied to the base of a power transistor 7 which controls the power circuit for a solenoid 8 of fuel injection nozzle means. Consequently, the solenoid 8 is energized for a time or duration corresponding to the pulse length of individual pulses in the pulse signal thereby opening a fuel injection nozzle (not shown) for the time or duration to effect injection of a corresponding quantity of fuel into an intake passage not shown in the figure.

Figure 4:
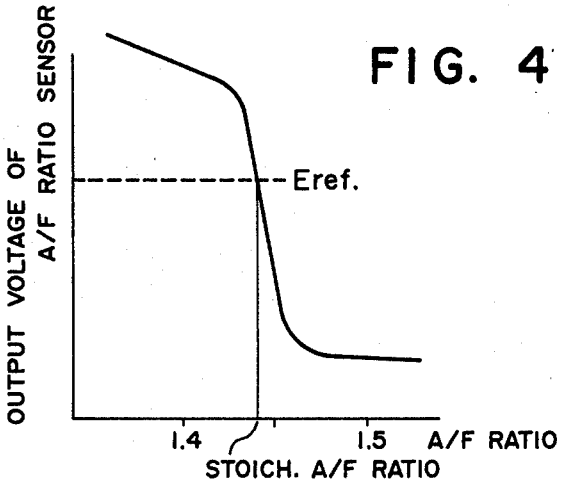

The air/fuel ratio sensor, such as a solid electrolyte type fuel cell and a metal oxide type resistor ($TiO_2$, SnO), is provided in an exhaust gas passage (not shown in the figure) and detects the air/fuel ratio of the engine intake mixture from combustible components and residual oxygen contained in the exhaust gases flowing through the exhaust passage. In this embodiment, the sensor is of the Zirconia solid electrolytic type and, in this case, the sensor is turned On (low level voltage) when the air/fuel ratio of the engine intake mixture is on the larger side of the stoichiometric ratio and is turned Off (high level voltage) when the air/fuel ratio is on the smaller side of the stoichiometric ratio. In other words, the sensor produces an on-off signal in accordance with shifting of the air/fuel ratio on to the rich or lean side of the stoichiometric ratio. The on-off signal produced by the air/fuel ratio sensor 6 is compared with a reference voltage $E_{ref}$ which corresponds to the stoichiometric air/fuel ratio (see FIG. 4) to generate a wave signal which is then supplied to an integration circuit 10 to be integrated therein on the basis of time thereby producing a voltage signal which increases together with time based upon the integration time constant of the integration circuit 10. The output voltage of the integration circuit 10 is supplied to the basic pulse length modifying circuit 5 and modifies, i.e., increases or decreases the length of the pulses included in the pulse signal delivered from the basic pulse generating circuit 3.

The integration circuit 10 comprises a transistor; for example, npn transistor 11 in the shown embodiment, a capacitor 12 and an operational amplifier 13 wherein the resistance between the collector and emitter of the transistor forms a resistance for the operational amplifier. The collector is connected with the output terminal of the comparator 9 while the emitter is connected with an input terminal of the operational amplifier 13. Another input terminal of the operational amplifier is grounded. The capacitor 12 is connected between said one input terminal and the output terminal of the operational amplifier 13 in parallel therewith. The base of the transistor 11 is connected with the output terminal of a frequency-voltage converter 15 by way of a resistor 14. The frequency-voltage converter 15 is supplied with the on-off signal from the comparator 9 by way of a diode 16 for checking inverse flow. Consequently, the frequency-voltage converter produces an analog voltage signal in accordance with the frequency of the input of the on-off signal, this voltage signal being applied to the base of the transistor 11.

Consequently, since the resistance between the collector and emitter of the transistor 11; i.e., the resistance for the integration circuit 10 lowers in accordance with an increase in the voltage applied to the base of the transistor, the resistance for the integration circuit lowers in accordance with an increase of the frequency of the on-off signal delivered from the air/fuel ratio sensor 6. In other words, the integration time constant of the integration circuit 10 becomes smaller in accordance with an increase of the intake air flow of the engine. Thus, the rise of the output from the integration circuit 10 is accelerated and, in accordance therewith, the delay time in modification of the pulse length effected in the basic pulse length modification circuit 5 is shortened thereby increasing the rate of increasing injection quantity of fuel.

Figure 1:
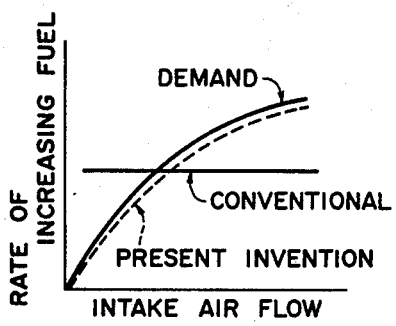
FIG. 1 is a graph showing the relation between intake air flow and the rate of increasing or decreasing the quantity of fuel.
Figure 2:
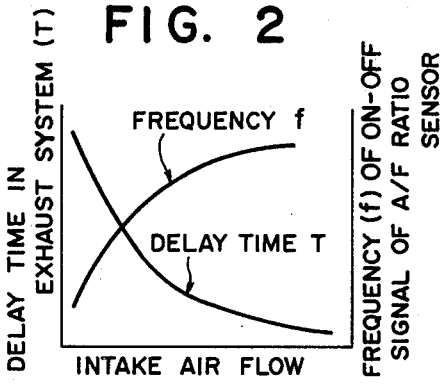
FIG. 2 is a graph showing the relation between intake air flow and the delay of response in an exhaust system and the frequency of the on-off signal produced by the air/fuel ratio sensor.

By this arrangement, the fuel increasing ratio can be adjusted to follow the requirement curve illustrated in FIG. 1.

Although the invention has been illustrated and described with reference to a particular embodiment thereof, it is to be understood by those skilled in the art that various modifications and/or omissions with respect to the embodiment can be made without departing from the spirit of the invention.

I claim:

1. An electronic feedback system for controlling fuel injection means in an internal combustion engine of the fuel injection type, comprising an air/fuel ratio sensor for sensing the air/fuel ratio of the intake fuel-air mixture from the combustible components and residual oxygen contained in the exhaust gases of said engine, said air/fuel ratio sensor producing an ON-OFF signal;

an integration circuit receiving said ON-OFF signal from said air/fuel ratio sensor and generating an integrated signal for controlling said fuel injection means, said integration circuit including an operational amplifier, a capacitor and a transistor having collector, emitter and base electrodes, the resistance between said collector and emitter electrodes and the capacitance of said capacitor determining the integration time constant of said integration circuit; and a frequency-voltage converter coupled between the output of said air/fuel ratio sensor and the base of said transistor for converting said ON-OFF signal to a voltage signal which changes in accordance with a change in the frequency of said ON-OFF signal within a variable range, the resistance between the collector and emitter electrodes of said transistor varying gradually with gradual variation in said voltage signal within said variable range.

2. The system of claim 1, wherein the transistor is of the npn type.

3. The system of claim 1, wherein said sensor is of the Zirconia solid electrolytic type.

4. The system of claim 1 which further comprises a diode interposed between the output of said air/fuel ratio sensor and the input of said frequency voltage converter.

5. The system of claim 4 which further comprises a comparator having first and second inputs and an output, said first input being coupled to the output of said air/fuel ratio sensor, said second input being coupled to a reference voltage and said output being coupled to the input of said integration circuit and to said diode.

* * * * *